US005531828A

United States Patent [19]

Whang

[11] Patent Number: 5,531,828

[45] Date of Patent: Jul. 2, 1996

[54] ADHESIVE MOISTENER

[76] Inventor: William Whang, 16161 Nordhoff #278, North Hills, Calif. 93143

[21] Appl. No.: 419,090

[22] Filed: Apr. 10, 1995

[51] Int. Cl.[6] ..... B05C 1/00

[52] U.S. Cl. ..... 118/264; 118/265; 118/268; 118/270; 156/441.5

[58] Field of Search ..... 118/264, 265, 118/268, 270; 156/441.5, 305, 308.6, 308.8

[56] References Cited

U.S. PATENT DOCUMENTS

| | | | |
|---|---|---|---|
| 1,018,592 | 2/1912 | Stacy | 118/265 |
| 2,564,842 | 8/1951 | Helmuth | 118/268 |
| 4,069,789 | 1/1978 | Fukagawa et al. | 118/264 |
| 4,180,430 | 12/1979 | Gelman | 156/441.5 |
| 5,316,581 | 5/1994 | Staniszewski | 118/264 |

FOREIGN PATENT DOCUMENTS

| | | | |
|---|---|---|---|
| 172431 | 6/1906 | Germany | 118/270 |
| 962493 | 7/1964 | United Kingdom | 156/441.5 |

*Primary Examiner*—Laura Edwards
*Attorney, Agent, or Firm*—Roger A. Marrs

[57] ABSTRACT

A device for moistening the adhesive of a sheet material such as the flap of an envelope or a postage stamp, is disclosed having a container with hinged lid. A moistened sponge is stored in the container having raised a step adjacent to the latch closure of the lid with the front wall of the container and is provided with a deep recess adjacent to the hinge connection of the lid with the container. A slider is movably carried on the lid and includes a pressure plate adapted to press against the top surface of the inserted sheet material forcibly urging the adhesive surface onto the moistened sponge step. The slider has two positions, one position with the pressure plate projecting into the recess when the lid is closed and the other position when advanced to be adjacent the step. A limit stop is carried on the container beneath the sponge step for limiting pivotal movement of the lid to prevent latching of the lid when the slider is in its advanced position.

9 Claims, 2 Drawing Sheets

FIG. 1.
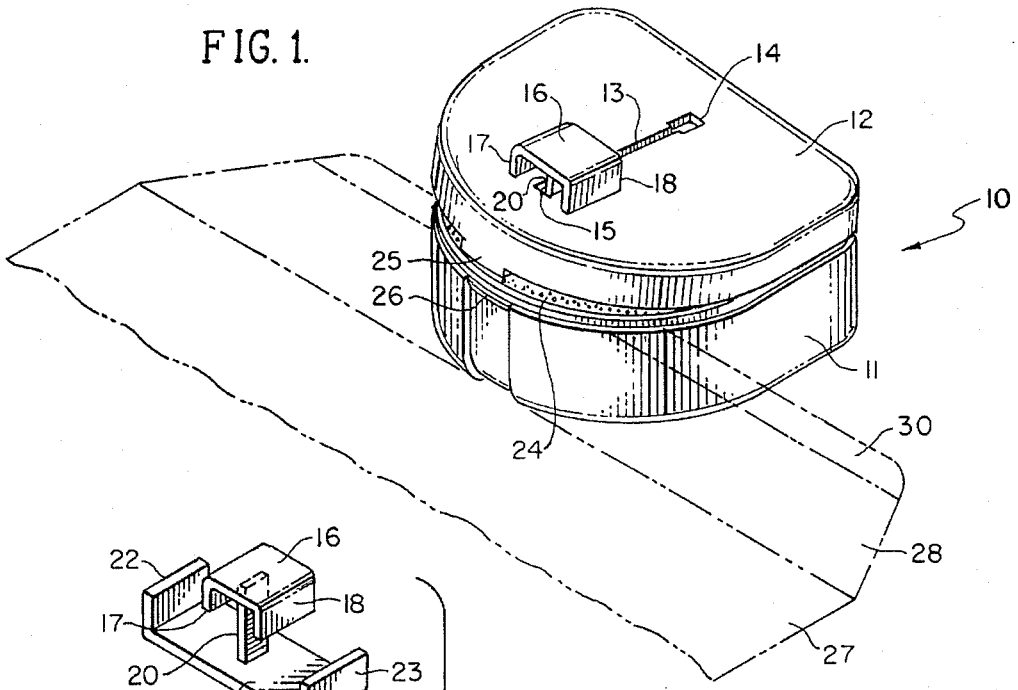
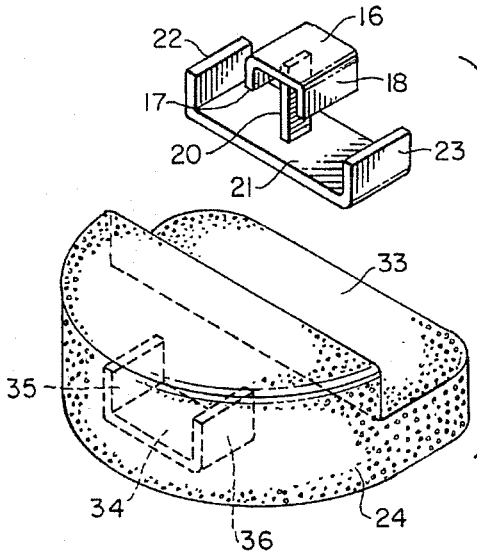
FIG. 5.
FIG. 4.
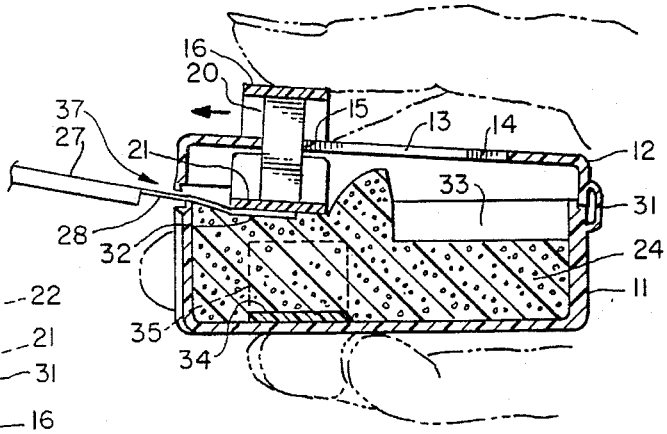
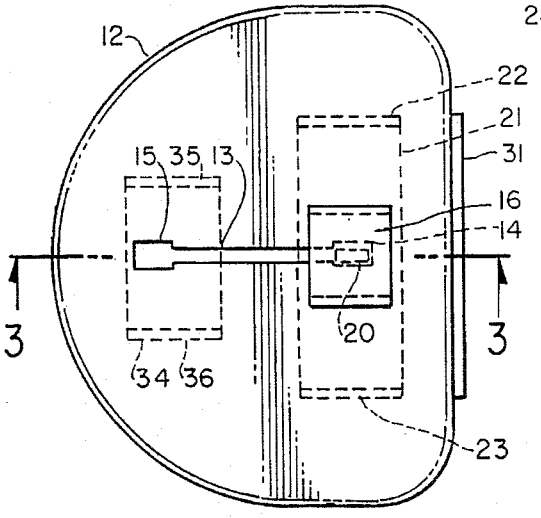
FIG. 2.
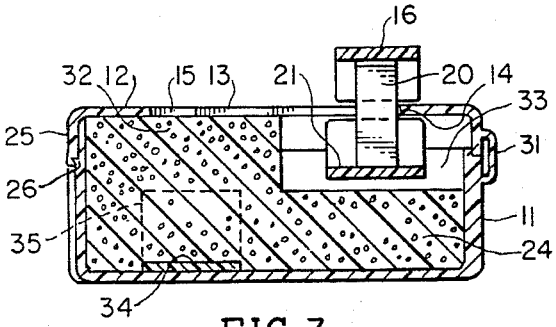
FIG. 3.

ADHESIVE MOISTENER

BACKGROUND OF THE INVENTION

1. Field of the Invention

The present invention relates to the field of stationary accessories, and more particularly to a novel device for moistening the adhesive carried on the surface of a sheet which provides a movable pressure plate carried on a slider for selectively engaging the sheet and forcing its adhesive surface into contact with a moistened material such as a sponge or the like.

2. Brief Description of the Prior Art

In the past, a multiplicity of devices have been provided for moistening the adhesive of envelope flaps, adhesive surfaces on stamps and other similar products. Usually, the moistening device takes the form of a tube containing water with a sponge-like material affixed to one end which is maintained in a moist condition by the water within the tube. Such a device has proved to be cumbersome to use and sometimes drips water onto the desk or other papers. Even if a cap is employed, the device has a tendency to drip and, of course, the cap sometimes becomes lost when separated from the tube.

Another attempt to provide an adhesive moistening device is a dish containing a domed sponge or sponge-like material that is moist and the user manipulates the envelope flap, stamp or other adhesive material over the dome portion of the moistened sponge. Such a device rapidly loses its moisture to atmosphere via evaporation and the device is large in the sense that it has a substantial diameter and is raised above the surface of the desk on which it may be supported. The device is not adapted to be stored in a desk drawer, cabinet shelf or the like.

Therefore, a long-standing need has existed to provide a novel adhesive moistening device which may maintain a moistened condition so as to reduce evaporation and which may be convenient for the user to draw an adhesive sheet over the moistening element without spilling or dripping of water. Such a device must be able to be opened and closed with convenience and contain no separable parts which may be lost or misplaced. Also, it is extremely useful that the device be able to be placed into a desk drawer or storage cabinet when not in use.

SUMMARY OF THE INVENTION

Accordingly, the above problems and difficulties are avoided by the present invention which provides a novel device for moistening the adhesive surface of a sheet which includes a container for holding a moistened element, such as a sponge-like material of synthetic composition or the like, and which includes a hinged lid adapted to alternately cover and expose the moistened element. The moistened element includes a front portion which may be referred to as a step, and a rear portion adjacent to the hinge, which is formed with a deep recess. A movable slider is carried on the lid and adapted to move between the rear of the container to the forward or front of the container, and the slider includes a pressure plate which resides within the moist element recess when the lid is closed and bears against the moist element step when the lid is partially open. In the open position, the moist surface of the element is exposed for insertably receiving the adhesive material while the pressure plate bears against the material to forcibly urge the adhesive surface into contact with the moist element. Latch means are provided between the container and the lid for releasably closing the lid so as to prevent evaporation of the moist condition of the element. A limit stop means is provided for preventing closure of the lid with the container when the slider and pressure plate is in its forward operative position engageable with the step of the moist element.

Therefore, a primary object of the present invention is to provide a novel means for moistening the adhesive surface of a sheet which includes a self-contained moist element and which further includes a slider pressure plate means adapted to be moved over a selected portion of the moist element so that the adhesive surface can be forcibly urged into contact therewith.

Another object of the present invention is to provide a novel moistening device for stationary use whereby an adhesive surface carried on a sheet may be slidably inserted beneath a pressure plate and a moist element whereby the adhesive surface may be moistened without loss of fluid from a container holding the moist element.

Still a further object of the present invention is to provide a novel moistening device which is convenient to use and which will not inadevertently spill or drip fluid onto a surrounding work area when in use.

Still a further object of the present invention is to provide a novel adhesive moistener which may be readily closed so as to prevent evaporation of the liquid contained therein and adapted to be stored in a cabinet, desk drawer or in a convenient shelf location.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view showing the novel device for moistening an adhesive surface in accordance with the present invention;

FIG. 2 is a top plan view of the device shown in FIG. 1;

FIG. 3 is a transverse cross-sectional view of the device for applying moisture to an adhesive surface as taken in the direction of arrows 3—3 or FIG. 2;

FIG. 4 is a view similar to the view of FIG. 3 illustrating the partial opening of the lid so as to expose the moistening step of the moist element within the container during an actual moistening procedure;

FIG. 5 is a perspective view of the slider and pressure plate elements as well as the moist element used in the device of the present invention;

DESCRIPTION OF THE PREFERRED EMBODIMENT

Figure 9:
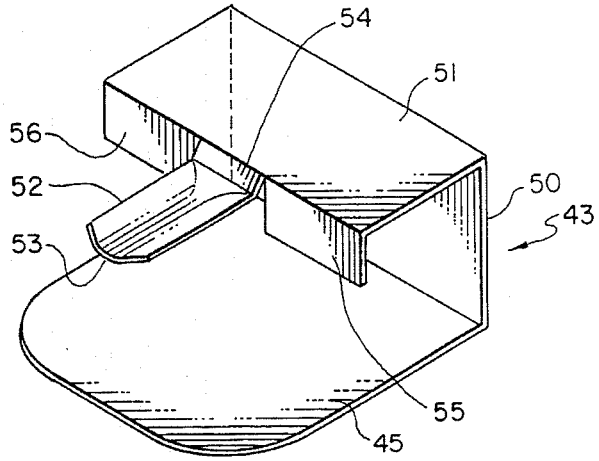
FIG. 9 is a front perspective view of a single piece applicator used in the embodiment shown in FIGS. 6–8 inclusive.

Referring to FIG. 1, the novel device for moistening an adhesive sheet is illustrated in the general direction of arrow 10, which includes a container 11 having a hinged lid 12 carried thereon. The lid 12 is provided with an elongated slot 13 having an enlarged opening 14 at the rear of the slot and a similar enlarged opening 15 at the front or other end of the slot. A slider 16 is mounted in the slot 13 so that the slider may move in a rectilinear manner between the openings 14 and 15 by the finger of the user. The slider includes a pair of support legs 17 and 18 which bear against the top surface of the lid 12 and slidably move therealong. The slider includes a downwardly depending web 20, shown more clearly in FIG. 5, which terminates on the opposite side of the lid 12 with a pressure plate 21. The plate 21 includes legs 22 and 23 which bear against the underside of the lid 12 so that cooperating in unison with the legs 17 and 18, maintains the slider on the lid 12.

The container 11 includes an internal cavity which is occupied by a moist element 24 that may take the form of an open cell foam composed of synthetic material, such as polyurethane or the like, or may take the form of a sponge or sponge-like material. The element 24 is intended to hold moisture, such as water, and is intended to provide that the surface of the element be continuously moist. The lid 12 includes a latch 25 operable to work in cooperation with a catch 26 to close the lid on the container whereby the moisture in the element 24 cannot escape through evaporation.

FIG. 1 further illustrates that an envelope shown in broken lines and represented by numeral 27 may include a folding flap 28 that has a top surface and an undersurface carrying an adhesive substance or material intended to be moistened. The flap 28 is a sheet material and the adhesive material may be of any conventional substance and is broadly represented by the numeral 30.

Referring now in detail to FIG. 2, it can be seen that the lid 12 is attached to the container 11 by means of a hinge 31 at the rear of the device adjacent to the opening 14. The opening 20 is adjacent to the front of the device. Preferably, the slot 13 and the slider 16 are arranged midway between the opposite sides of the lid 12.

Referring now in detail to FIG. 3, it can be seen that the slider 16 is above the moist element 24 and that the element includes a forward step 32 which is adjacent to the front of the container 11 while the other end of the element 24 is formed with a recess 33 which is immediately adjacent to the rear of the container 11 adjacent to the hinge connection 31. Included in the moisture element is a limit stop 34 which includes a pair of upright legs 35 and 36 so that the stop has the shape of a yoke. The legs 35 36 are insertably disposed within recesses formed on the underside of the element 24 and an interference fit is produced which holds the stop 34 in position. Also, the base of the stop 34 resides against the bottom of the container 11. The stop 34 is of sufficient height so that when the slider element 16 is pressed, the pressure plate 21 will be forced to compress the material of the moist element 24 until the pressure plate 21 bottoms against the terminating ends of legs 35 and 36. This is critically located so that the lid 12 cannot be latched into a closed position until the slider 16 has been returned to its storage position so that the pressure plate 21 resides within the recess 33.

Referring now in detail to FIG. 4, the device is illustrated in its storage position with the lid 12 closed so that the latch 25 engages with the catch 26. This maintains the moist element 24 substantially enclosed so as to eliminate evaporation of the moisture contained within the cells or cavities of the moist element. In this condition, the slider 16 is at the rear of the container so that the web 20 is within the opening 14. The pressure plate 21 resides within the cavity 33. In this condition, the container may be placed into a desk drawer or other storage place without fear of spillage or moisture evaporation.

Use of the device is illustrated in FIG. 4 wherein the slider 16 is positioned forward by the fingers of the user to where the web 20 resides within the front opening 15. In this position, the latch and catch have been separated and the lid 12 slightly rotated on its hinge 31 so as to create a small linear opening at the front of the container. Such an opening is indicated in the direction of arrow 37 and it is through this opening that the flap 28 is drawn so that the adhesive surface 30 engages in sliding relationship with the step 32 of the moist element. The sponge-like or foam-like material of the moist element compresses as the slider 16 is pressed downwardly by the finger of the user so that the pressure plate 21 urges enforceable relationship against the top of flap 28 forcing the adhesive surface 30 into contact with the moist element 24 and the step 32 thereof. After the moistening procedure, if the user attempts to close the lid 12 without returning the slider 16 to its rearward position where the web 20 is in opening 14, the downward pressure will cause the step 32 to completely compress so that the pressure plate is stopped from moving downwardly by engagement of the compressed material against the terminating ends of legs 35 and 36 of the limit stop 34. Therefore, the device cannot be inadvertently stored away with the slider in its operative position and the lid unlatched. In order to prepare the device for storage, the slider must be returned to its nonoperative position with web 20 in opening 14 so that the latch and catch 25 and 26 respectively can be closed as shown in FIG. 3. It should be noted that a feature resides in providing the ends of slot 13 with enlarged openings 14 and 15 so that the slider cannot inadvertently travel from its nonoperative position to its operative position unless controlled by the user. The web 20 must be aligned with the opening of the opposite ends of the slot in order to be moved out of the respective enlarged openings 14 or 15.

Figure 8:
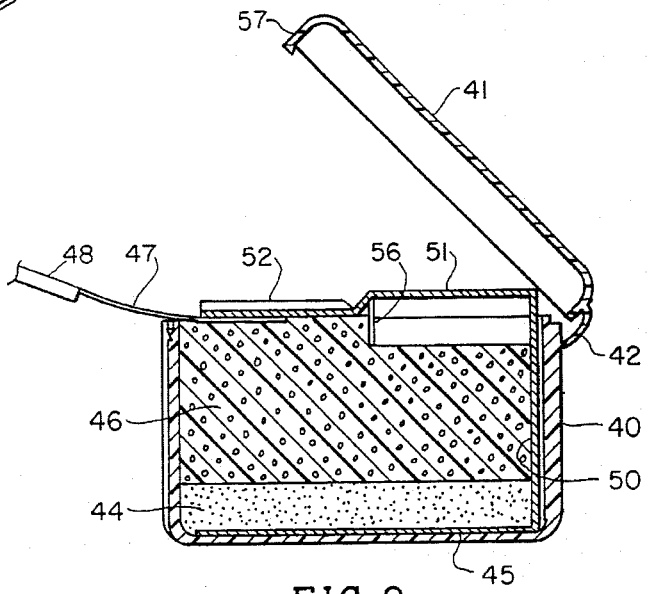
FIGS. 6–8 inclusive illustrate another embodiment of the present invention.
Figure 6:
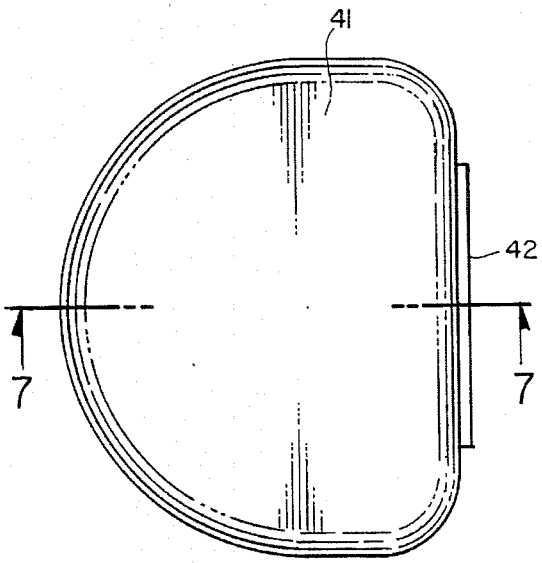
Figure 7:
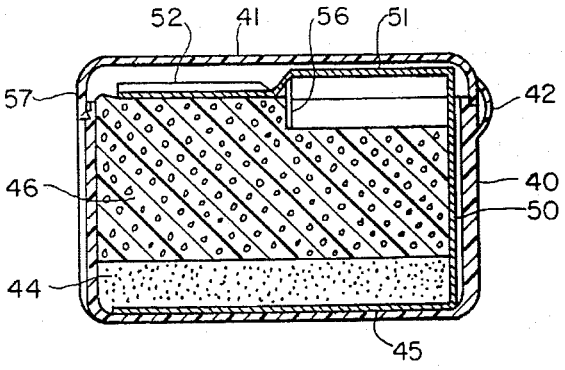

Referring now in detail to FIGS. 6–8 inclusive, another embodiment of the invention is illustrated wherein a box-like housing 40 includes a lid 41 which is hinged to the backside by means of an integral hinge 42. The box includes a central cavity which is occupied by an applicator 43 which is illustrated in detail in FIG. 9. A quantity of sand or other weighted material, such as metal shot or the like, is indicated by numeral 44 and is on top of a base 45 integrally formed with the applicator 43. Placed on top of the weighted material, such as sand, there is an open-cell foam material 46 which is moistened and is prevented from evaporation when the lid 41 is closed, such as shown in FIG. 7. However, when the lid 41 is open, as shown in FIG. 8, moisture is present on the top surface of the foam pad or block 46 so that it is available to contact the adhesive on a flap 47 carried on envelope 48.

It can be seen that the applicator 43 includes a back wall 50 which connects the base 45 with a support plate 51. Outwardly projecting from the support plate 51, there is provided a projection 52 which is of U-shape or V-shape in transverse cross-section. The underside of the projection 52 includes a contact surface 53 that engages in sliding relationship with the top of the flap 47 as the flap is moved between the contact surface 53 and the upper side or surface of moistened block 46. The projection 52 is spring-biased into engagement with the block 46 by means of an integral leaf or metal connection 54 with the support 51. In this manner, a slight yieldable pressure is placed on the projection 52 maintaining the surface 53 in contact with the moistened block. This yieldable pressure is applied to the top of the flap 47 when the flap is introduced between the surface and the top of the block. Furthermore, the support plate 51 includes downwardly depending stops 55 and 56 which are employed to limit the insertion of the flap 47 beneath the projection 52. In other words, should the user insert the flap beyond the point where the adhesive ion the flap is being moistened, the end of the flap will impact against the plate 56 or 55 and limit the insertion.

By placing the weighted material 44 on top of the base 45 within the cavity of the housing 40, the moistening device can be left on a surface, such as a desk or table, and the user need only use one hand to slide the item intended to be moistened under the projection 52. By closing the lid 41, as shown in FIG. 7, evaporation is retarded and a releasable snap-lock latch 57 may be used to maintain the lid in a closed condition. The adhesive moistener may be considered stationary and the weighted material is sufficient to hold the device in place while it is being used. The applicator 43 is of one piece construction so that a unitary construction is provided, While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An adhesive sheet moistener comprising:

a container having an internal storage compartment;

a block of porous composition holding a moisturizing substance disposed in said storage compartment and having an upper portion exposed beyond said container storage compartment;

a lid hingeably carried on said container operable to selectively expose said upper portion when said lid is in its open position and to conceal said upper portion when in its closed position;

pressure plate means slidably carried on said lid operable in a forward operative position to effect depression of said upper portion when said lid is in its open position and pressure is applied thereto; and an entrance defined between said lid and said container for insertably accepting the adhesive sheet between said pressure plate means and said upper portion when said pressure plate means is in its forward operative position.

2. An adhesive sheet moistener comprising:

a container having an internal storage compartment;

a block of porous composition holding a moisturizing substance disposed in said storage compartment and having an upper portion exposed beyond said container storage compartment;

a lid hingeably carried on said container operable to selectively expose said upper portion when said lid is in its open position and to conceal said upper portion when in its closed position;

pressure plate means carried adjacent said lid operable to effect depression of said upper portion;

said pressure plate means is a slider movably carried on said lid; and said slider having a plate yieldably engageable with said upper portion.

3. The invention as defined in claim 2 wherein:

said lid includes an elongated slot and said slider includes a finger-engaging element movable through said slot and secured to said plate for advancing and retraction of said plate between a forward operative position and a rear nonoperative position.

4. The invention as defined in claim 3 including:

a rigid limit stop member secured in said container in spaced-apart alignment with said pressure plate when said plate is in its forward operative position.

5. The invention as defined in claim 4 wherein:

a portion of said block resides in compressible relationship between said plate and said limit stop member.

6. An adhesive sheet moistener comprising:

a container having an internal storage compartment;

a block of porous composition holding a moisturizing substance disposed in said storage compartment and having an upper portion exposed beyond said container storage compartment;

a lid hingeably carried on said container operable to selectively exposure said upper portion when said lid is in its open position and to conceal said upper portion when in its closed position;

slidable plate means carried adjacent said lid to effect depression of said upper portion, said pressure plate means including a rigid applicator having a base with an upright rear wall and a support plate cantilevered outwardly from said rear wall partially extending over said block of porous composition; and a plate having one end thereof resiliently biased in attachment with said support plate so as to project outwardly over said upper portion.

7. The invention as defined in claim 6 including:

weighted material disposed in said container on said base and separating said block of porous composition from said base.

8. The invention as defined in claim 7 wherein:

said plate is of U-shaped configuration.

9. The invention as defined in 8 including:

a limit stop downwardly depending from said support plate extending beneath said pressure plate means limiting insertion of an article intended to be moistened.

* * * * *